US008148901B2

(12) United States Patent
Morimoto et al.

(10) Patent No.: US 8,148,901 B2
(45) Date of Patent: Apr. 3, 2012

(54) LIGHT SOURCE APPARATUS WITH POWER FEEDER STRUCTURE

(75) Inventors: Shunichi Morimoto, Hyogo (JP); Takehiko Iguchi, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 74 days.

(21) Appl. No.: 12/289,173

(22) Filed: Oct. 22, 2008

(65) Prior Publication Data

US 2009/0102344 A1 Apr. 23, 2009

(30) Foreign Application Priority Data

Oct. 23, 2007 (JP) ..... 2007-274647

(51) Int. Cl.
*H01J 17/18* (2006.01)
*H01J 61/36* (2006.01)

(52) U.S. Cl. ..... 313/623; 313/113; 313/484; 313/567; 313/637

(58) Field of Classification Search ..... 313/113, 313/567, 484, 623, 637, 638, 643
See application file for complete search history.

(56) References Cited

U.S. PATENT DOCUMENTS 4,757,236 A * 7/1988 Dakin et al. ..... 313/638
4,959,588 A * 9/1990 Vida et al. ..... 313/625
5,016,150 A * 5/1991 Gordin et al. ..... 362/263
5,059,865 A * 10/1991 Bergman et al. ..... 315/82
5,128,589 A * 7/1992 Dakin ..... 313/634
5,229,681 A * 7/1993 Gordin et al. ..... 313/25
5,258,691 A * 11/1993 Dakin et al. ..... 313/620
5,660,462 A * 8/1997 Bockley et al. ..... 362/256
5,856,721 A * 1/1999 Gordin et al. ..... 313/25
2002/0135304 A1* 9/2002 Honda et al. ..... 313/634
2005/0127841 A1* 6/2005 Maseki et al. ..... 313/637
2007/0013281 A1* 1/2007 Miyasu et al. ..... 313/24

FOREIGN PATENT DOCUMENTS

JP 63-72058 A 4/1988
JP 2002-352771 A 12/2002
JP 2003-51286 A 2/2003
JP 2004-95375 A 3/2004
JP 2005-515593 A 5/2005
JP 2006-253008 A 9/2006
WO WO-03/060948 A2 7/2003

* cited by examiner

*Primary Examiner* — Toan Ton
*Assistant Examiner* — Kevin Quarterman
(74) *Attorney, Agent, or Firm* — Rader, Fishman & Grauer PLLC

(57) ABSTRACT

A light source apparatus, comprises a lamp housing, a xenon lamp provided in the lamp housing, a reflection mirror which reflects light emitted from the xenon lamp, and first and second power feeders which supply electric power to the xenon lamp, wherein a direction of the first power feeder connected to one end of the xenon lamp and a direction of the second power feeder connected to the other end thereof are approximately in point symmetry with respect to a center of lamp axis connecting electrodes which face each other.

18 Claims, 5 Drawing Sheets

LIGHT SOURCE APPARATUS WITH POWER FEEDER STRUCTURE

CROSS-REFERENCES TO RELATED APPLICATION

The disclosure of Japanese Patent Application No. 2007-274647, filed Oct. 23, 2007 including its specification, claims and drawings, are incorporated herein by reference in its entirety.

TECHNICAL FIELD

The present invention relates to a light source apparatus, and specifically relates to a light source apparatus for a xenon lamp which is used for a movie etc., using the digital light processing technology (DLP: registered trademark of TEXAS INSTRUMENTS, INC.) etc., and which has the structure for stabilizing an arc of the xenon lamp arranged in the light source apparatus.

BACKGROUND

Conventionally, a xenon lamp having an electrical discharge space in which xenon gas is enclosed, is used widely for a light source apparatus which projects an image in a movie theater, etc. The light source apparatus is very large, so that a large installation area may be required therefore. However, with recent developments of the digital technology, a technology in which, instead of an image which was conventionally obtained through a film, a digital image is used has been developed. With such developments, a type of light source apparatus in which a digital image formed on a liquid crystal display or a digital mirror device (DMD: Registered trademark of TEXAS INSTRUMENTS, INC.), is projected and enlarged, starts to be used, and the light source apparatus itself is required to be small. Moreover, the xenon lamp arranged in the light source apparatus is also required to be small, compared with the conventional xenon lamp, so that the development of miniaturization has been advanced.

On the other hand, when projecting a digital image on a screen, as represented in the DLP (registered trademark) technology, a high quality image is required, and a high stability of light emitted from a xenon lamp arranged in the light source apparatus is also required. If operating time of the xenon lamp becomes long, flickering tends to occur. The reason is considered as set forth below. When switching on the xenon lamp, direct current is impressed therein. For this reason, electrodes, that is, a cathode and an anode are separately designed from each other. In general, the anode is large in volume, and is made of high melting point metal material, for example, pure tungsten metal material. Moreover, the cathode is small in volume, and is made of high melting point metal material containing the emitter (the so-called emitter substance). For example, an electrode made of a thorium tungstate (hereinafter referred to as Th-W) in which thorium is contained in tungsten, is used. Thermoelectrons are emitted from the cathode made from the Th-W electrode, at time of lamp lighting, so that electric discharge is maintained. Although electrons in the metal material are generally emitted as thermoelectrons by heating the metal material in a discharge lamp, when the electrode contains an emitter substance, it is possible to easily emit thermoelectrons therefrom without heating of the metal material.

Here, when the cathode contains thorium, since electron emission is carried out easily, the thermionic emission in low energy becomes possible. In an early stage of lamp lighting, the thorium sufficiently exists across the tip of the cathode, so that thermoelectron radiation is easily carried out even in low energy so that electric discharge of the lamp is stable. However, when the lamp is turned on for a long time, since the thorium is gradually evaporated etc. from a surface portion of the tip of the cathode, the quantity of the thorium contained at the tip of the cathode decreases, so that the thermionic emission from the tip of the cathode becomes difficult. In this case, the temperature of the cathode is raised by shrinking an arc of the cathode and increasing electric input per unit area, the electric discharge is maintained by emitting thermoelectrons without the thorium. Since the thorium which exists inside the cathode leaks therefrom to the cathode surface by raising the temperature of the cathode at this time, thermoelectrons can be emitted easily again. Then, the cathode maintains the electric discharge, while an arc is expanded again. The thorium which has leaked out to the cathode surface evaporates again, so that it goes into a thorium drain state because the electric discharge continues, and the arc is shrunk in order that the temperature of the cathode is raised as mentioned above. While repeating expansion and contraction of the arc, portions where thermoelectrons tend to be emitted at time of contraction are not fixed, and arc generating positions move. It is considered that the movement of the arc generating section and the expansion and contraction of the arc is the cause of generation of flickering of the arc.

Although flickering tends to occur in a xenon lamp as mentioned above if an operating time becomes long, it is necessary to stabilize light emitted from a xenon lamp when the xenon lamp is used as a light source apparatus, such as DLP (registered trademark) etc. For this reason, the various attempts have been made in order that an electric discharge arc of such a xenon lamp is stabilized. For example, Japanese Laid Open Patent Nos. 2003-51286 and 2004-95375 are known as such attempts. Japanese Laid Open Patent No. 2003-51286 teaches that flickering of an arc is controlled by line of magnetic force which is generated by using a movable magnet arranged in a direction perpendicular to a lamp axis connecting between electrodes which are arranged in a discharge lamp and which face each other.

Moreover, Japanese Laid Open Patent No. 2004-95375 teaches the technology of stabilizing an arc by providing at least three lead wires arranged in parallel to a lamp axis connecting electrodes of the discharge lamp and in point symmetry with respect to the lamp axis so that current is made to flow therethrough so as to form a magnetic field. In the technology disclosed in Japanese Laid Open Patent No. 2004-95375, an arc is compressed toward the central axis of the lamp by the magnetic field generated by current which flows through the lead wires arranged in point symmetry, so that the brightness density of the arc is increased and fluctuation of the arc is controlled.

SUMMARY

In a light source apparatus used for such DLP (registered trademark) etc., demands of a miniaturization and a raise in brightness is growing in recent years. In response to such demands, the full length of such a xenon lamp used therefore is made short, and input electric power to the lamp also become large. An example of input electric power and current applied to a conventional xenon lamp and a small xenon lamp for DLP (registered trademark), full length thereof are shown in Table 1.

TABLE 1

| Sample No. | Lamp to be used. | Input Power (KW) | Current (A) | Full Length (mm) |
|---|---|---|---|---|
| 1 | Prior Art | 2 | 70-80 | 300-350 |
| 2 | Prior Art | 3 | 90-100 | 300-400 |
| 3 | DPL | 3 | 90-100 | 225-270 |
| 4 | DPL | 4 | 120-130 | 300-350 |

Table 1 shows input electric power (kW), current (A), and lamp full length (mm) of a small size xenon lamp of the prior art (Sample Nos. 1 and 2) and a xenon lamp for DLP (Sample Nos. 3 and 4), respectively. A sample lamp No. 1 which is the conventional xenon lamp, is 300-350 mm in full length, input electric power thereof is 2 kW and lamp current thereof at time of lighting is 70-80 (A). On the other hand, when the lamp full length of the small xenon lamp for DLP is made to 300-350 mm so as to match up with that of the sample lamp No. 1, as shown as a sample lamp No. 4, the input electric power thereof is set to 4 kW, and the lamp current thereof is set to 120-130 (A). Moreover, when the input electric power and the current value are matched up with those of sample lamps No. 2 or No. 3, while the conventional xenon lamp needs 300-400 mm in full lamp length, the full lamp length of the small size xenon lamp for DLP is very short, that is, 225-270 mm. That is, it turns out that, compared with the conventional xenon lamp, in the small xenon lamp for DLP, the lamp full length thereof is short and a current value tends to become large.

On the other hand, as mentioned above, the various attempts have been made in order to conventionally stabilize an electric discharge arc of a xenon lamp. For example, means for stabilizing an arc is provided, has been proposed as described in Japanese Laid Open Patent Nos. 2003-51286 and 2004-95375. However, a miniaturization of the light source apparatus used for DLP (registered trademark) etc. as mentioned above is desired. For this reason, as shown in Japanese Laid Open Patent Nos. 2003-51286 and 2004-95375, it becomes difficult to provide a movable magnet in a lamp housing or to secure a space for arranging such lead wires, in order to stabilize an electric discharge arc. Moreover, when these components are provided, there is a possibility that they produce shadow, thereby affecting the emission light.

Moreover, input electric power and current to a lamp are increasing with a raise in the brightness of the lamp. Therefore, the size of a magnetic field produced around the lead wires through which lamp current flows also becomes large. Moreover, it became impossible to secure a sufficient distance between a lamp and a conductive member due to the miniaturization of a lamp housing. For this reason, it became impossible to ignore the influence on an arc by the magnetic field produced around the conductive member through which lamp current flows. FIGS. 5A and 5B schematically show an arrangement example of power feeders in a lamp of a conventional light source apparatus, respectively. In these figures, a light source apparatus 1 has a xenon lamp 2, a lamp housing 4, and power feeders 10 and 11, wherein an opening which is a light emission opening 7 is provided in a front face of the lamp housing 4. Magnetic fields B1 and B2 are produced by current which flows through the power feeders 11 and 10, and B indicate a synthetic magnetic field thereof, and current I flows through the lamp. Electromagnetic force F acts on an arc due to the magnetic flux B and the current I. In addition, although a parabolic type reflection mirror, or a globular form reflection mirror, etc. which condenses light of the lamp 2 is provided in the lamp housing 4, it is omitted in this figure.

FIG. 5A is an example in which the power feeders 10 and 11 are extended and arranged toward the lamp 2 from a lower part of the lamp housing 4, wherein current is made to flow through the lamp 2 via the power feeder 11 from the lower part of the lamp 2, and the current which flows out of the lamp 2 is made to flow downward via the power feeder 10. In this arrangement, when the current I flows in a direction of an arrow in the figure via the power feeders 10 and 11, magnetic flux occurs around the power feeders 10 and 11 by the law of a right screw. Since the direction of the current which flows through the power feeder 10 and that of the current which flows through the power feeder 11 are opposite to each other, the direction of the magnetic flux due to the power feeder 10 and that of the magnetic flux due to the power feeder 11 are the same as each other, near the light emission portion of the lamp 2 (hereinafter a globular form portion at the center is referred to as a bulb 1*a*). Therefore, a direction of the magnetic field B due to the current which flows through the power feeders 10 and 11 becomes a direction shown in this figure. Moreover, since the direction of current which flows through the lamp 2 is the direction of I of this figure, a direction of the electromagnetic force F which acts due to the magnetic field B and the current I is upward, so that the arc of the lamp 2 may be raised up.

Here, as a cause of flickering in the brightness of the xenon lamp, it is considered that an arc floats due to influence of a gas convection. In general, such a xenon lamp is lighted in a state where a lamp axis connecting electrodes which face each other is set so as to be horizontal. For this reason, an electromagnetic force is applied to an arc formed between the electrodes so as to raise the arc in an upper and vertical direction, due to the heat convection of the gas enclosed inside the electrical discharge space. However, in an early stage of lamp lighting, the emitter amount contained in the cathode is large, and the flow of the electrons in the arc, which flows toward the anode from the cathode is vigorous. For this reason, the electromagnetic force which rises in the vertical and upward direction due to the convection of the gas does not have a big influence on the arc itself.

On the other hand, the emitter amount contained in the cathode is depleted, and the flow of the electrons in the arc, which flow toward the anode from the cathode becomes loses the vigor at the end of life of the discharge lamp. Moreover, the shape of the tip of the cathode is also deformed, compared with that in the early stage of lighting (due to evaporation of cathode material, and/or the local temperature rise due to the arc concentration at time of emitter drain, etc.). For these reasons, the arc is influenced by the convection. At this time, a position where an arc is generated moves on the cathode due to expansion and contraction of the arc associated with emitter depletion. Moreover, the intensity of the electron flows at the time of arc expansion and that at arc contraction, are different from each other, and it is greatly influenced by the above-mentioned convection. Therefore, the arc floats under the influence of the gas convection, and is not stabilized, so that flickering arises in the brightness of the lamp. Therefore, as shown in FIG. 5A, when electromagnetic force which raises the arc of the lamp 2 upward acts, is applied, since the floating of the arc is promoted, it becomes much easier to cause flickering.

In FIG. 5B, power feeders 10 and 11 are arranged from a side of the lamp housing 4, and current is passed through a lamp 2 via the power feeder 11 from the longitudinal direction of the lamp 2, so that the current which flowed out of the lamp 2 is passed in a longitudinal direction via the power feeder 10. If, in this arrangement, current flows through the power feeders 10 and 11 in the direction of the arrow of this figure, the direction of the magnetic flux by the power feeders 10 and 11 is the same as each other near a bulb 1*a* of the lamp 2, and the direction of a magnetic field B is as in the figure. Moreover, since the direction of the current I which flows through the lamp 2 is as in the figure, the electromagnetic force F which is caused by the magnetic field B and the current I, is in a longitudinal direction, is applied to the arc of the lamp 2 so that the arc may be shifted from the central axis of the lamp to the side thereof. Therefore, as mentioned above, an arc floats under the influence of a gas convection, and at the end of life of the discharge lamp, flickering is produced, much more easily.

As mentioned above, the current which flows through a power feeder becomes large by miniaturization and high output of a light source apparatus, such as DPL (registered trademark), with which it becomes impossible to ignore the influence of a magnetic field produced by the current to an arc of a lamp. For this reason, depending on arrangement of a power feeder, a force is applied to an arc of a lamp due to the magnetic field and the lamp current, so that there is a problem that the arc of the lamp may be shifted from the central axis of the lamp, thereby increasing flickering of the lamp. In view of the above-mentioned situation, it is an object of the present invention to offer a light source apparatus in which the stability of light emitted from a xenon lamp is increased by reducing flickering of an arc of the xenon lamp provided in the light source apparatus, which is used for DLP (registered trademark) etc.

In order to solve the above problems, in the present invention, a light source apparatus, comprises a lamp housing, a xenon lamp provided in the lamp housing, a reflection mirror which reflects light emitted from the xenon lamp, first and second power feeders which supply electric power to the xenon lamp, wherein a direction of the first power feeder connected to one end of the xenon lamp and a direction of the second power feeder connected to the other end are approximately in point symmetry with respect to a center of lamp axis connecting electrodes which face each other.

Another aspect of the present invention is to offer a light source apparatus, comprising a lamp housing, a xenon lamp provided in the lamp housing, a reflection mirror which reflects light emitted from the xenon lamp, and first and second power feeders which supply electric power to the xenon lamp, wherein the first power feeder connected to one end of the xenon lamp and the second power feeder connected to the other end thereof are approximately in point symmetry with respect to a center of lamp axis connecting electrodes which face each other so that magnetic fields generated by the first and second power feeders are mutually offset.

The first power feeder may extend upward, and the second power feeder extends downward.

The first and second power feeders may extend horizontally.

The first power feeder may extend obliquely downward and the second power feeder may extend obliquely upward.

In the present invention, since the first power feeder connected to the xenon lamp and the second power feeders are provided in point symmetry arrangement, the magnetic flux generated by the current which flows through the power feeders can be mutually offset. Therefore, it is possible to reduce flickering of the xenon lamp which resulted from influence to the electric discharge plasma of the xenon lamp due to magnetic flux generated by the current which flows through the power feeders.

BRIEF DESCRIPTION OF THE DRAWINGS

Other features and advantages of the present light source apparatus will be apparent from the ensuing description, taken in conjunction with the accompanying drawings, in which.

DESCRIPTION

The descriptions in the specification are provided for illustrative purposes only, and are not limiting thereto. An appreciation of various aspects of the present light source apparatus is best gained through a discussion of various examples thereof. The meaning of these terms will be apparent to persons skilled in the relevant arts based on the entirety of the teachings provided herein.

In the present invention, power feeders are arranged so that influence of the magnetism generated by current which flows through the power feeders connected to a xenon lamp provided in a light source apparatus is offset, thereby reducing flickering of the lamp. Hereafter, an embodiment of a light source apparatus for DLP (registered trademark) according to the present invention will be described below.

Figure 1:
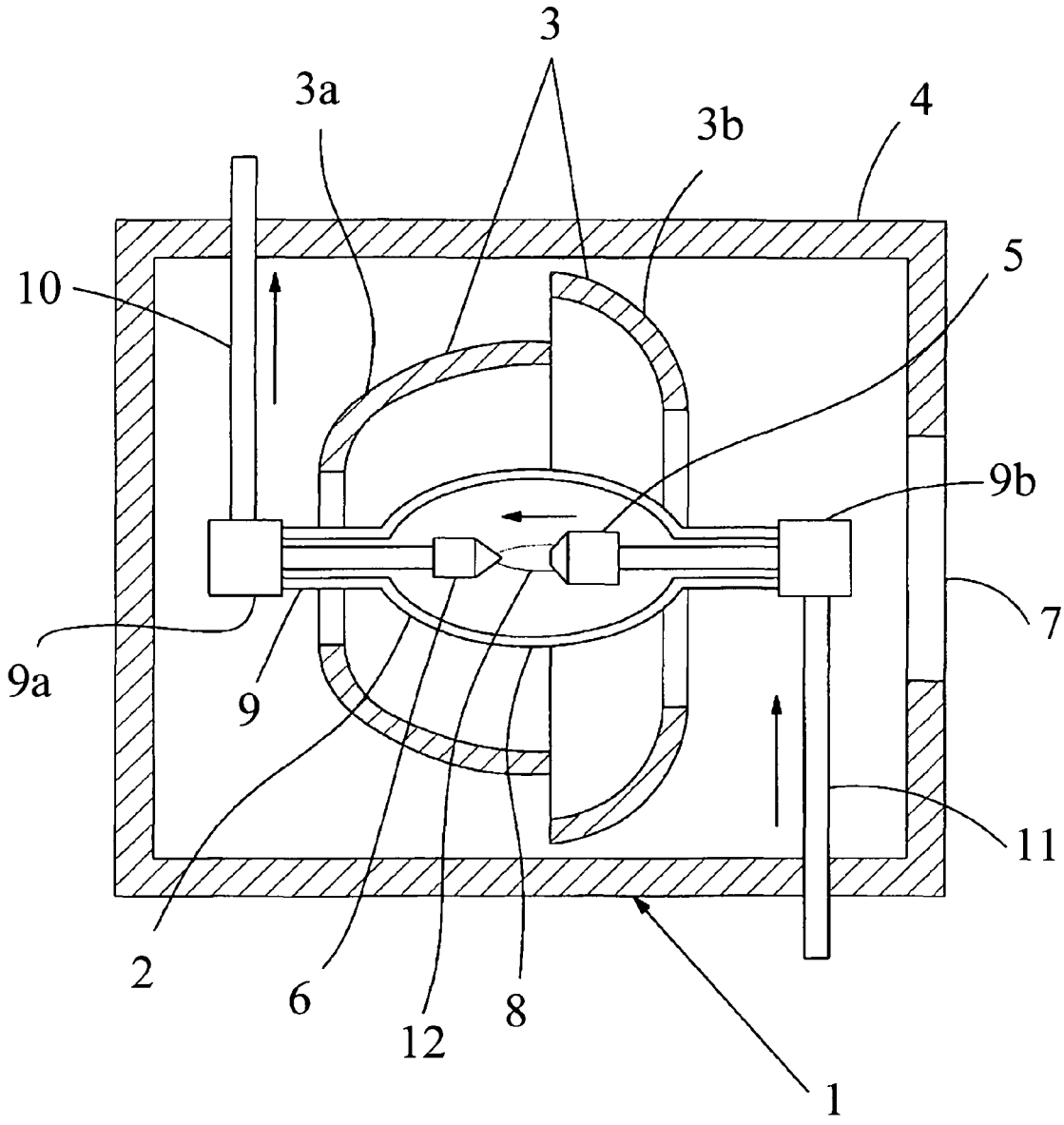
FIG. 1 is a view showing the structure of a light source apparatus according to a first embodiment of the present invention.

A first embodiment of the present invention is shown in FIG. 1. FIG. 1 is a cross sectional view of the structure of a light source apparatus 1 having a xenon lamp 2, taken along a vertical plane which passes through an axis connecting electrodes of the lamp to each other. In this embodiment, the light source apparatus 1 is made up of a lamp housing 4 having the xenon lamp 2 and a reflection mirror 3. The reflection mirror 3 comprises a parabolic type reflection mirror 3*a* arranged in a side of a cathode 6 of the xenon lamp 2, and a globular form reflection mirror 3*b* arranged in a side of an anode 5 of the xenon lamp 2. Moreover, in the lamp housing 4, a light emission opening 7 provided in a side of the anode 5 of the xenon lamp 2 arranged inside the lamp housing 4 is formed. The anode 5 and the cathode 6 are arranged so as to face each other in a bulb 8 of the xenon lamp 2, so that an electric discharge arc 12 may be formed between the anode 5 and the cathode 6. Moreover, in the bulb 8, xenon gas is enclosed, for example, with 20 atmospheric pressure. Furthermore, in the xenon lamp 2, a stem section 9 which projects from the bulb 8, and mouthpiece sections 9*a* and 9*b* which are provided at end portions of the stem section 9, are provided. In this embodiment, a power feeder 10 which extends above the lamp housing 4 is provided in the mouthpiece section 9*a* arranged in a side of the cathode 6. Moreover, a power feeder 11 which extends under the lamp housing 4 is provided in the mouthpiece section 9*b* arranged in a side of the anode 5. The power feeders 10 and 11 are approximately arranged at point symmetry to the center on a lamp axis connecting the electrodes 5 and 6 which face each other. Current supplied to the lamp 1 flows in the path of the power feeder 11→the anode 5 of the lamp 1→the cathode 6→the power feeder 10, as shown in arrows of the figure.

Figure 2:
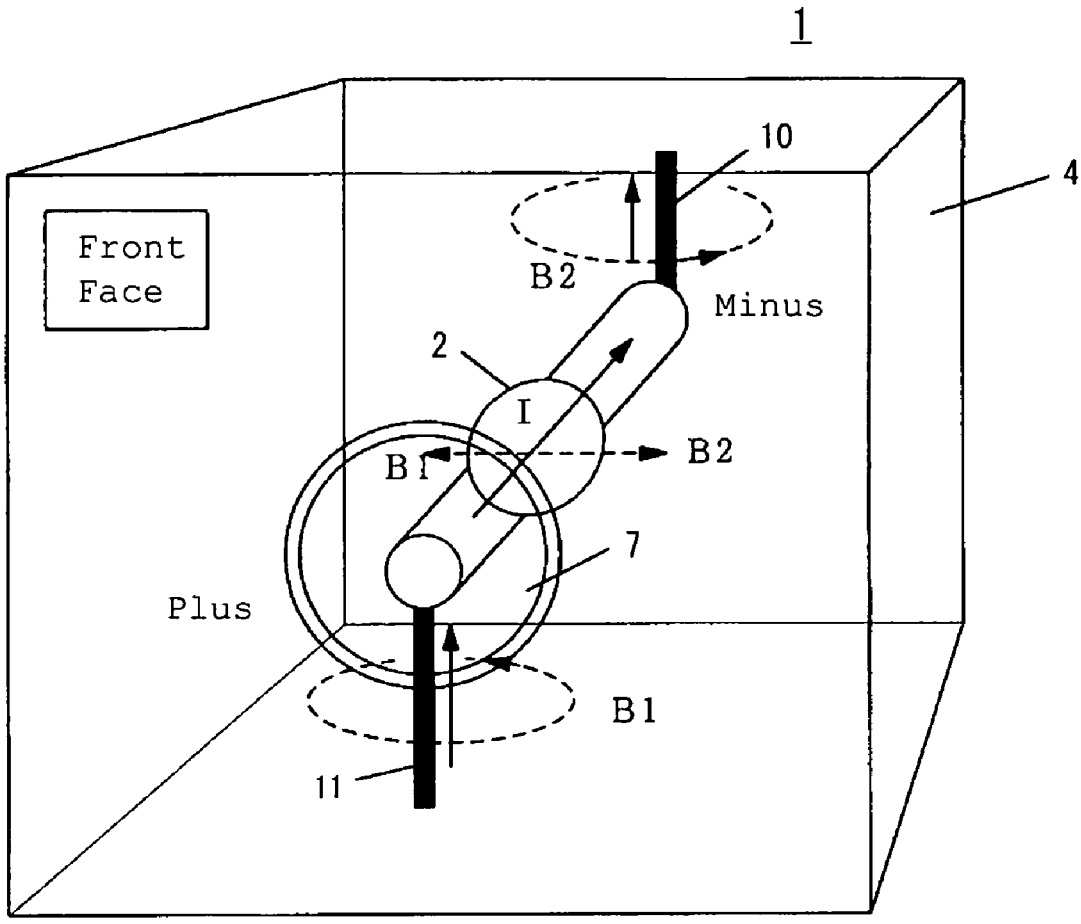
FIG. 2 schematically shows an arrangement, a direction of a magnetic field, a direction of current, and a direction of electromagnetic force of power feeders in a light source apparatus according to the first embodiment.

FIG. 2 schematically shows an arrangement of the power feeders to the lamp according to this embodiment. The light source apparatus 1 is made up of the lamp housing 4 having the xenon lamp 2, and the power feeders 10 and 11 are provided. The opening which is the light emission opening 7 is provided in front of the lamp housing 4. Moreover, magnetic fields B1 and B2 are produced by current which flows through the power feeders 10 and 11, respectively, and current I flows through the lamp. In addition, the parabolic type reflection mirror and the globular reflection mirror provided in the lamp housing 4 etc., are not shown in the figure. The current supplied to the xenon lamp 2 flows from the power feeder 11 to the power feeder 10 through the anode and the cathode. At this time, the direction of the magnetic flux generated corresponding to a direction where current flows, becomes the same direction as that in which a right screw is rotated when, according to the Ampere's right handed screw rule, the right screw is carried forward in a direction in which current flows. Here, the direction of the current which flows through the power feeder 10 and the power feeder 11 is the same as each other. However, the power feeders 10 and 11 are approximately arranged at point symmetry to the center on a lamp axis connecting the electrodes 5 and 6 of the xenon lamp 2. The magnetic fields B1 and B2 which are generated by the respective power feeders 10 and 11 acts in the direction where the magnetic fields are mutually offset as shown in this figure.

Thus, by arranging the power feeders 10 and 11 which supply electric power to the xenon lamp 2, in a direction where the magnetic fields B1 and B2 generated by passing current through the power feeders 10 and 11, are mutually offset, it is possible to prevent an electric discharge arc from floating due to the influence of the magnetic field as described above, so that the electric discharge arc can be prevented from being unstable. Especially, in the xenon lamp 2, having a short full length, through which large current is passed in order to obtain high brightness, although the magnetic fields produced around the power feeders 10 and 11 which supply electric power to the xenon lamp 2 also become large, in the present arrangement of power feeders like this embodiment, the magnetic fields generated with the current which flows through the power feeders 10 and 11 can fully be controlled.

Figure 3:
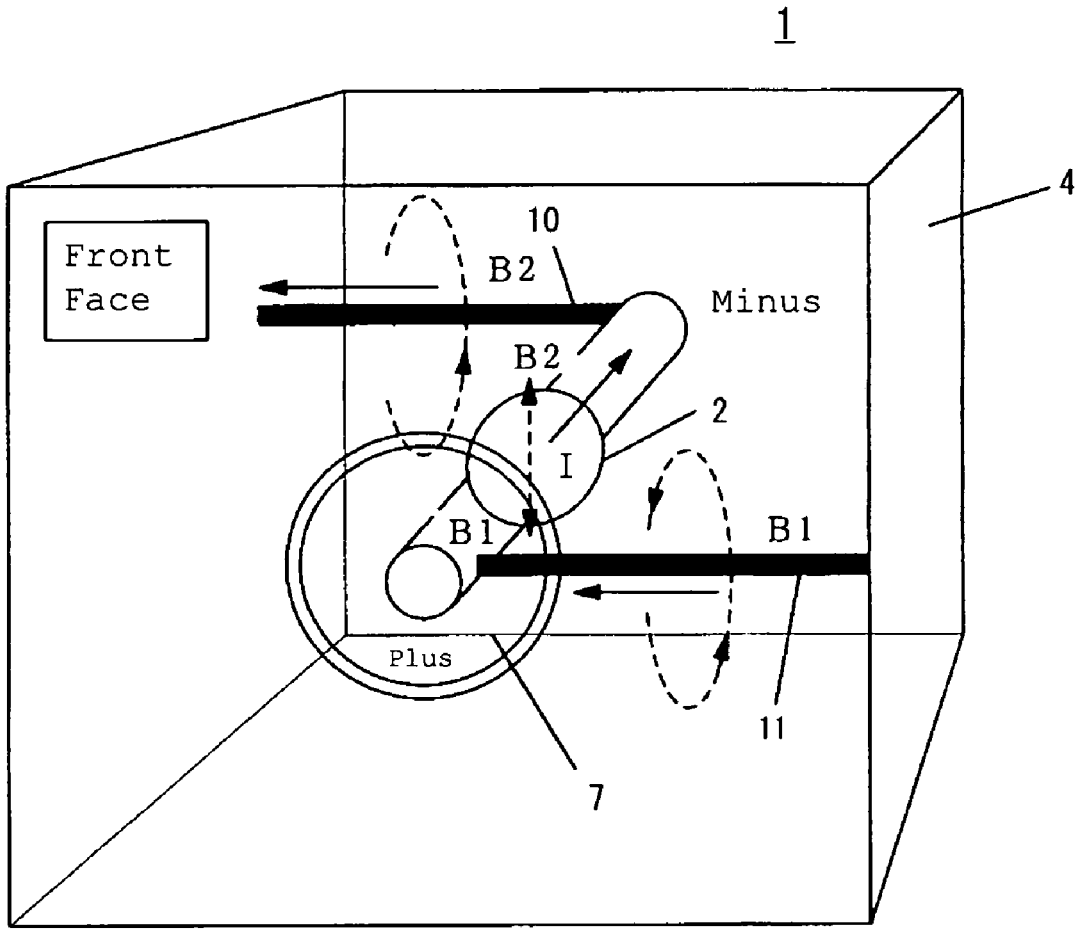
FIG. 3 schematically shows an arrangement, a direction of a magnetic field, a direction of current, and a direction of electromagnetic force of power feeders in a light source apparatus according to a second embodiment of the present invention.

FIG. 3 schematically shows an arrangement of the power feeders to the lamp according to a second embodiment of the present invention. As described above, the light source apparatus 1 is made up of a lamp housing 4 having a xenon lamp 2, and power feeders 10 and 11 are provided. An opening which is a light emission opening 7 is provided in front of the lamp housing 4. In addition, a parabolic type reflection mirror and a globular reflection mirror provided in the lamp housing 4 etc., are not shown in the figure. In FIG. 3, current supplied to the xenon lamp 2 flows to the xenon lamp 2 from a longitudinal direction of the lamp housing 4 through the power feeder 11, and then flows from the xenon lamp 2 in the longitudinal direction of the lamp housing 4 through the power feeder 10. In this case, as in the first embodiment, the power feeders 10 and 11 are approximately arranged at point symmetry to the center of a lamp axis connecting the electrodes 5 and 6 which face each other. The magnetic fields B1 and B2 generated in the respective power feeders 10 and 11 acts in the direction where the magnetic fields are mutually offset as shown in this figure.

By arranging the power feeders 10 and 11 which supply electric power to the xenon lamp 2 in this manner, the magnetic fields B1 and B2 which are generated around the power feeders 10 and 11 can be mutually offset as in the first embodiment, it is possible to prevent an electric discharge arc from becoming unstable since, as described above, the electric discharge arc does not shift from the central axis of the lamp, due to the influence of the magnetic field. Especially, in the xenon lamp 2 having a short full length, through which large current is passed in order to obtain high brightness, by arranging the power feeders like this embodiment, the magnetic fields generated with the current which flows through the power feeders 10 and 11 can fully be suppressed.

Figure 4:
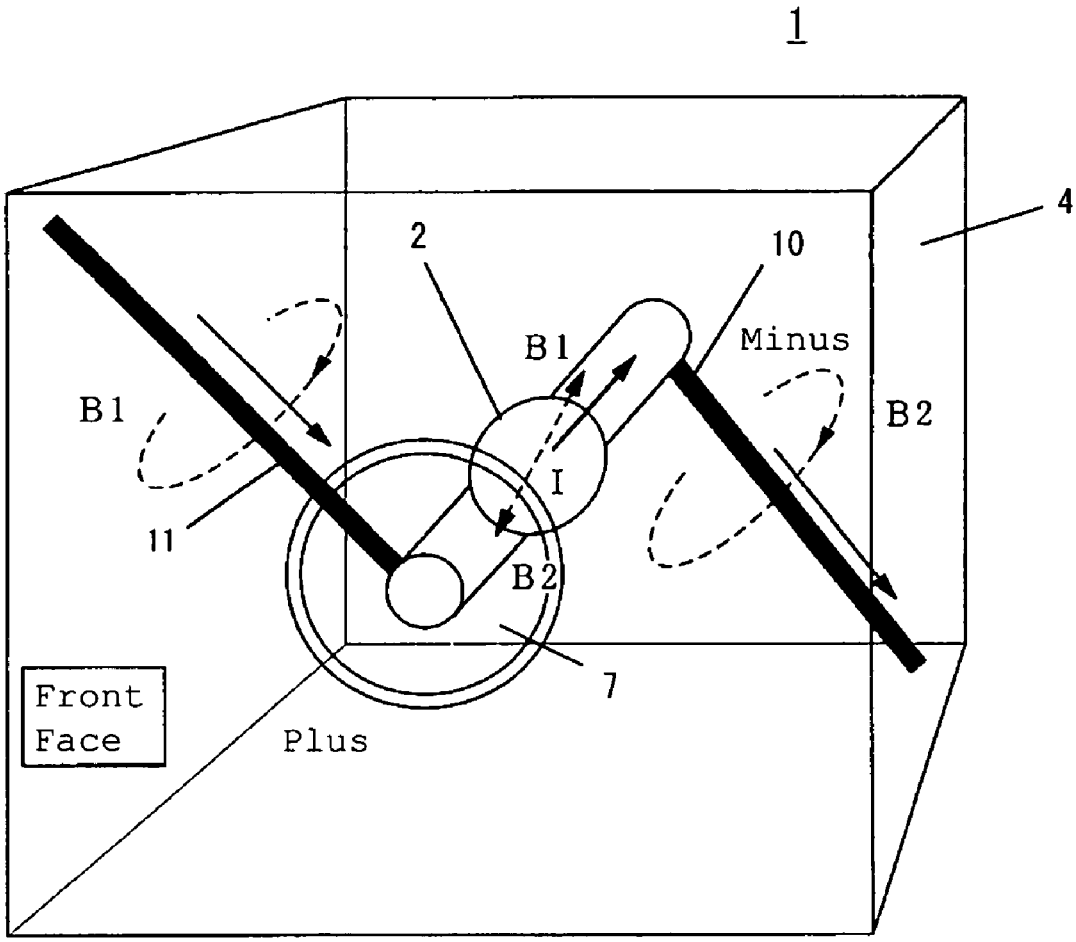
FIG. 4 schematically shows an arrangement, a direction of a magnetic field, a direction of current, and a direction of electromagnetic force of power feeders in a light source apparatus of a third embodiment of the present invention.
Figure 5A:
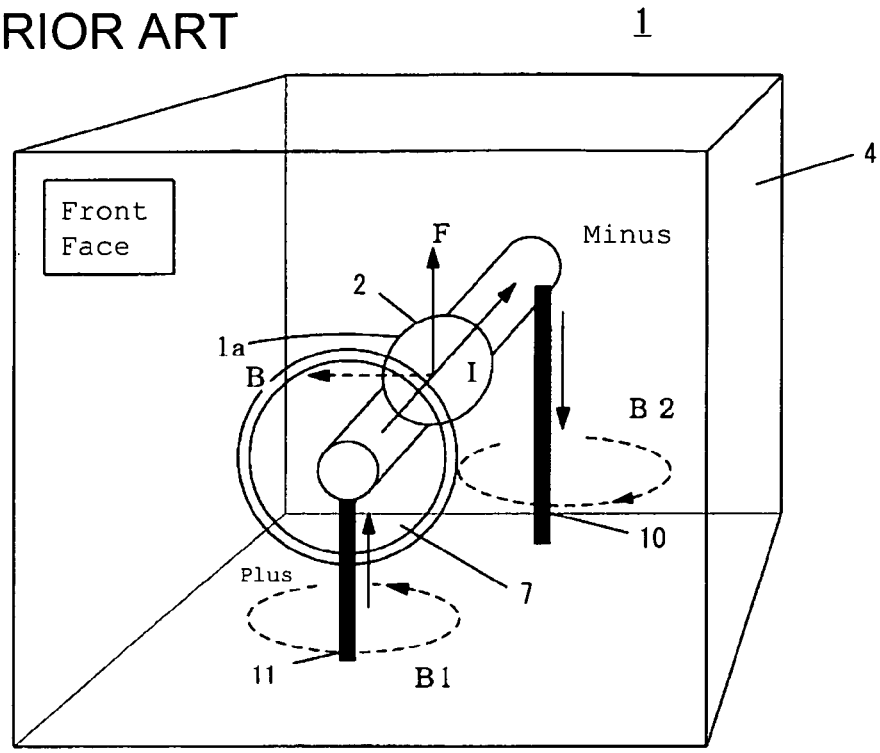
FIG. 5A PRIOR ART
FIGS. 5A and 5B schematically show an example of an arrangement of power feeders to the lamp in a conventional light source apparatus, respectively.
Figure 5B:
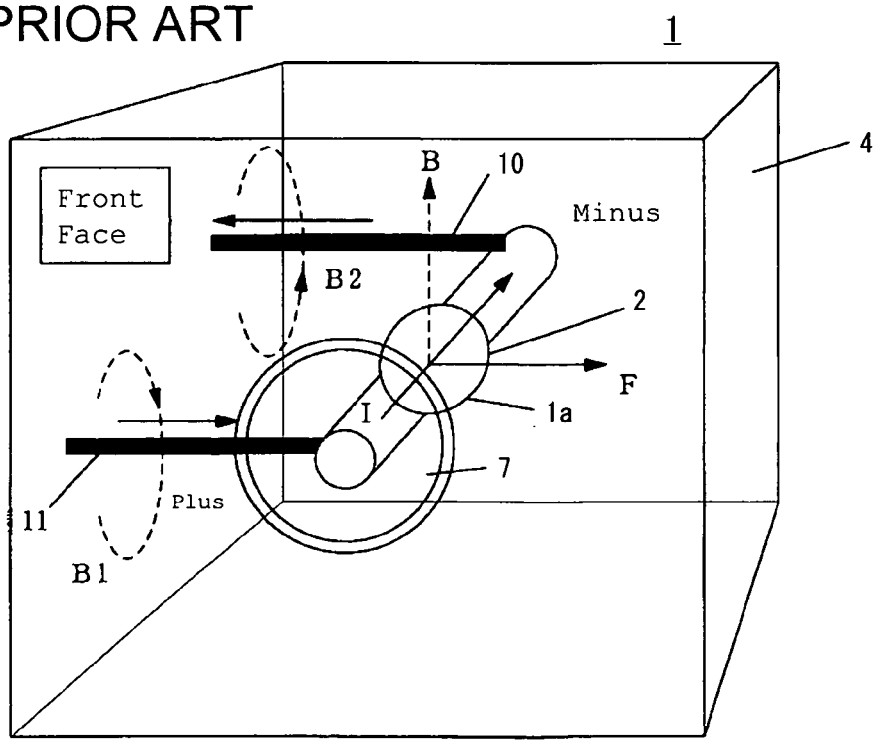
FIG. 5B PRIOR ART

FIG. 4 schematically shows an arrangement of power feeders to a lamp according to a third embodiment of the present invention. As described above, the light source apparatus 1 is made up of a lamp housing 4 having a xenon lamp 2, and power feeders 10 and 11 are provided. An opening which is a light emission opening 7 is provided in front of the lamp housing 4. In addition, a parabolic type reflection mirror and a globular reflection mirror provided in the lamp housing 4 etc., are not shown in the figure. In FIG. 4, the power feeders 10 and 11 are approximately arranged at point symmetry to the center of a lamp axis connecting the electrodes 5 and 6 which face each other. The current supplied to the xenon lamp 2 flows from an obliquely upper part of the lamp housing 4 to the xenon lamp 2 through the power feeder 11, and then flows to an obliquely lower part of the lamp housing 4 through the power feeder 10 from the xenon lamp 2. Also in this case, the magnetic fluxes B1 and B2 generated in the respective power feeders 10 and 11 act as in the first and second embodiments so that the magnetic fluxes are mutually offset as shown in the figure. Therefore, an electric discharge arc does not shift from the central axis of the lamp, so that it is possible to prevent the electric discharge arc from becoming unstable as described above due to the influence of the magnetic flux.

The preceding description has been presented only to illustrate and describe exemplary embodiments of the present light source apparatus. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A light source apparatus comprising:

a xenon lamp within a lamp housing, a stem section of said xenon lamp including an anode and a cathode;

a first power feeder, a portion of the first power feeder extends from said xenon lamp to a first face of the lamp housing;

a second power feeder, a portion of the second power feeder extends from said xenon lamp to a second face of the lamp housing, wherein an entirety of the portion of the first power feeder is approximately in point symmetry with an entirety of the portion of the second power feeder, the center of said point symmetry being between said anode and said cathode.

2. The light source apparatus according to claim 1, wherein said point symmetry is within said lamp housing.

3. The light source apparatus according to claim 1, wherein said first and second power feeders are within said lamp housing.

4. The light source apparatus according to claim 1, wherein said xenon lamp is between said first face and said second face.

5. The light source apparatus according to claim 1, wherein a space is between said first and second faces, said xenon lamp being disposed within said space.

6. The light source apparatus according to claim 1, wherein said first and second power feeders extend to and reach said lamp housing.

7. The light source apparatus according to claim 1, wherein said portion of the first power feeder extends from said xenon lamp to said first face along a first direction, said portion of the second power feeder extending from said xenon lamp to said second face along a direction other than the first direction.

8. The light source apparatus according to claim 7, wherein said first power feeder is planar with said second power feeder, said first and second power feeders being planar with said xenon lamp.

9. The light source apparatus according to claim 7, wherein said stem section extends along a lamp axis, a direction of said lamp axis being neither said first direction nor said direction other than the first direction.

10. The light source apparatus according to claim 9, wherein said anode and cathode are disposed along said lamp axis, said first and second power feeders extending from said stem section along axes other than said lamp axis.

11. The light source apparatus according to claim 1, wherein direct current is flowable from said first power feeder to said anode, said direct current being flowable from said cathode to said second power feeder.

12. The light source apparatus according to claim 11, wherein said direct current passes through said first and second power feeders generates magnetic fields, said magnetic fields from said first and second power feeders being mutually offset.

13. The light source apparatus according to claim 1, further comprising:

a reflection mirror configured to reflect light, said light being emitted from said xenon lamp.

14. The light source apparatus according to claim 13, wherein said reflection mirror is within said lamp housing, said light being emitted through an opening within said lamp housing.

15. The light source apparatus according to claim 13, wherein said reflection mirror includes a first mirror and a second mirror, said xenon lamp being between said first and second mirrors.

16. The light source apparatus according to claim 15, wherein said first mirror is a parabolic reflection mirror, said second mirror being a globular form reflection mirror.

17. The light source apparatus according to claim 15, wherein a portion of said stem section extends through an opening within said first mirror.

18. The light source apparatus according to claim 15, wherein a portion of said stem section extends through an opening within said second mirror.

* * * * *